US006731068B2

(12) United States Patent
Dakin et al.

(10) Patent No.: US 6,731,068 B2
(45) Date of Patent: May 4, 2004

(54) CERAMIC METAL HALIDE LAMP

(75) Inventors: James T. Dakin, Shaker Heights, OH (US); James A. Leonard, Shaker Heights, OH (US); Stuart A. Mucklejohn, Wigston Magna (GB); Gergely Ormandlaky, Budapest (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,218

(22) Filed: Dec. 3, 2001

(65) Prior Publication Data

US 2003/0102808 A1 Jun. 5, 2003

(51) Int. Cl.[7] ..... H01J 61/20
(52) U.S. Cl. ..... 313/640; 313/571
(58) Field of Search ..... 313/486, 487, 313/636, 640, 641, 571; 445/9

(56) References Cited

U.S. PATENT DOCUMENTS 3,564,328 A * 2/1971 Bagley et al. ..... 313/624
3,761,758 A * 9/1973 Bamberg et al. ..... 313/640
3,852,630 A * 12/1974 Wesselink et al. ..... 313/640
4,023,059 A * 5/1977 Anderson ..... 313/640
4,445,067 A * 4/1984 Inoue et al. ..... 313/54
4,503,356 A * 3/1985 Kobayashi et al. ..... 313/634
4,810,938 A * 3/1989 Johnson et al. ..... 315/248
5,212,424 A * 5/1993 Russell et al. ..... 313/562
5,239,232 A * 8/1993 Heider et al. ..... 313/639
5,451,838 A * 9/1995 Kawai ..... 313/638
5,512,800 A * 4/1996 Omura et al. ..... 313/637
5,698,948 A * 12/1997 Caruso ..... 313/637
5,861,714 A * 1/1999 Wei et al. ..... 313/625
5,973,454 A * 10/1999 Ooyama et al. ..... 313/639
6,200,918 B1 * 3/2001 Yanagitani et al. ..... 501/152
6,294,871 B1 * 9/2001 Scott et al. ..... 313/636
6,400,084 B1 * 6/2002 Eisemann ..... 313/640

* cited by examiner

*Primary Examiner*—Nimeshkumar D. Patel
*Assistant Examiner*—Glenn Zimmerman
(74) *Attorney, Agent, or Firm*—Fay, Sharpe, Fagan, Minnich & McKee, LLP

(57) ABSTRACT

A metal halide lamp comprised of a ceramic discharge chamber containing an ionizable fill, said fill comprising Hg, and halides (H) of Na, TI, an alkaline earth metal, and 0>rare earth element (Re)<15 as a molar fraction.

23 Claims, 1 Drawing Sheet

CERAMIC METAL HALIDE LAMP

BACKGROUND OF INVENTION

The present invention relates generally to lighting, and more particularly to a ceramic arc discharge lamp.

DISCUSSION OF THE ART

Discharge lamps produce light by ionizing a fill material such as a mixture of metal halides and mercury with an arc passing between two electrodes. The electrodes and the fill material are sealed within a translucent or transparent discharge chamber which maintains the pressure of the energized fill material and allows the emitted light to pass through it. The fill material, also known as a "dose", emits a desired spectral energy distribution in response to being excited by the electric arc. Halides generally provide spectral energy distributions that offer a broad choice of light properties, e.g., color temperatures, color renderings, and luminous efficacies.

A conventional metal halide lamp is fabricated by charging, in a light-transmitting quartz tube, mercury, an inert gas, e.g., argon (Ar), at least one kind of rare earth halide ($LnH_2$ or $LnH_3$: where Ln is a rare earth metal, e.g., scandium (Sc), yttrium (Y), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu), and H is chlorine (Cl), bromine (Br), iodine (I)), mercury (Hg), and at least one kind of alkali earth halide (NAX: where NA is an alkali metal, e.g., sodium (Na), lithium (Li), cesium (Cs), potassium (K), or rubidium (Rb)) and sealing the tube.

The requirement for metal halide lamp operation at high temperature often excludes the use of quartz or quartz glass for the discharge vessel wall, and necessitates the use of a ceramic material for the discharge vessel wall. Ceramic discharge lamp chambers were developed to operate at higher temperatures, e.g., above 950° C., for improved color temperatures, color renderings, and luminous efficacies, while significantly reducing reactions with the fill material. A ceramic discharge chamber is often made from metal oxide, such as, for example, sapphire or densely sintered polycrystalline $Al_2O_3$, as well as from metal nitride, for example AlN. Typically, ceramic discharge chambers are constructed from one or more components which are slip cast, molded, extruded or die-pressed from a ceramic powder.

Ceramic metal halide (CMH) lamps provide many benefits. For example, CMH lamps combine a high luminous efficacy with excellent color properties (among them general color rendering index $R_a \geqq 80$ and color temperature $T_c$ between 2600 and 4000 K) making them highly suitable for use as a light source for, inter alia, interior lighting.

In general, CMH lamps are operated on an AC voltage supply source with a frequency of 50 or 60 Hz, if operated on an electromagnetic ballast, or higher if operated on an electronic ballast. The discharge will be extinguished and subsequently be re-ignited in the lamp, upon each polarity change in the supply voltage.

Extension of CMH technology from low wattage to high wattage (for example, from less than or equal to 150 watts to a wattage greater than, for example, 250 watts) introduces several problems. Arc tubes are more prone to cracking due to the larger size. Furthermore, halide cost per volume becomes more important due to the larger volume of the arc tube legs. Similarly, it is harder to achieve Ra greater than 80 due to the lower mercury density associated with larger wattage at fixed voltage.

One mechanism for dealing with the problem associated with developing high wattage ceramic metal halide lamps is the selection of the appropriate arc discharge fill. Because of the effect on all characteristics of the lamp, including, lumen output, color temperature, efficiency, interaction with the arc discharge chamber, and starting capabilities, only to name a few, fill selection is a very complicated undertaking.

SUMMARY OF INVENTION

According to one aspect of the invention, a metal halide lamp having a ceramic discharge chamber is provided. The ceramic discharge chamber contains an ionizable fill. The fill is comprised of mercury and halides of at least sodium, thallium, an alkaline earth metal, and from greater than 0 to less than 15% of a rare earth element as a molar fraction of the halide fill constituents. Cesium halide may also be added to the fill to improve lamp life when the lamp is burning horizontally.

According to a further aspect of the invention, a metal halide lamp having a ceramic discharge chamber is provided. The ceramic discharge chamber contains an ionizable fill. The fill is comprised of mercury and halides of at least sodium, thallium, an alkaline earth metal, and from greater than 0 to less than 15% of three rare earth elements as a molar fraction of the halide fill constituents.

According to another aspect of the invention, a dose for a metal halide lamp is provided. The dose is comprised of mercury and halides of at least sodium, thallium, an alkaline earth metal, and from greater than 0 to less than 15% of three rare earth elements as a molar fraction of the halide fill constituents. According to a further aspect of the invention, a metal halide lamp having a ceramic discharge chamber is provided. The ceramic discharge chamber contains an ionizable fill. The fill is comprised of mercury and halides of at least sodium, cesium, thallium, an alkaline earth metal, and from greater than 0 to less than 15% of three rare earth elements as a molar fraction of the halide fill constituents.

BRIEF DESCRIPTION OF DRAWINGS

In accord with an exemplary embodiment of the present invention.

DETAILED DESCRIPTION

Figure 1:
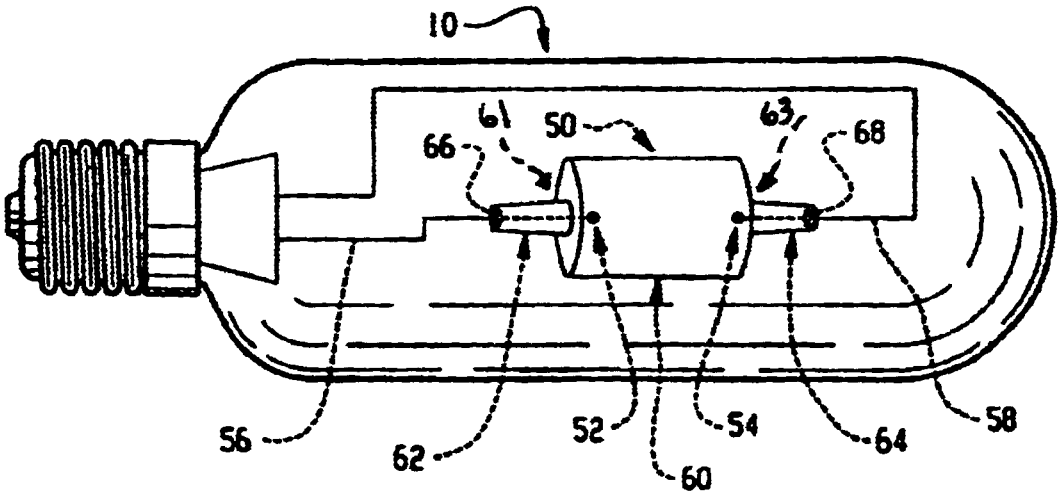
FIG. 1 depicts a ceramic metal halide lamp suited to include the present ionizable fill.

A representative low watt CMH lamp which achieves 3000° K color rendering at $R_a$ greater than 80 includes the following fill composition in addition to argon and mercury:

| Typical low watt CMH design | 70 Watt 3000 K CMH Lamp with Ra > 80 |
|---|---|
| Rare Earth element | Dy—Ho—Tm |
| Rare earth iodide molar fraction | 9% |
| Sodium iodide molar fraction | 86% |
| Sodium to Rare Earth plus Thallium molar ratio | 6.2 |
| Thallium iodide molar fraction | 5% |

CMH lamps built at 250 and 400 watts, using this dose, are normally unable to achieve an $R_a$ greater than 80 at an operating voltage of 100 volts, a desirable operating voltage to maintain compatibility with existing high pressure sodium lamp ballasts. The $R_a$ with a traditional halide dose can be increased by increasing mercury content, however, this also increases operating voltage to greater than 100 volts. At a much higher voltage, the lamp draws too much power, and has too much arc bowing, making it prone to cracking when burned horizontally.

FIG. 1 illustrates a discharge lamp 10 according to an exemplary embodiment of the invention. The lamp preferably has an operating voltage between about 80 and 110 volts when burned vertically which translates to between 90 and 120 volts when burned horizontally, and a power of greater than 200 watts, more preferably, between about 250 and 400 watts. Furthermore, the lamp preferably provides a color temperature between about 2500–4500° K, more preferably between about 2800°–3200°, and an Ra>80, more preferably 85<Ra<90.

Discharge lamp 10 includes a discharge chamber 50 which contains two electrodes 52, 54 and fill material (not shown). Electrodes 52, 54 are connected to conductors 56, 58, which drive current through the electrodes while applying a potential difference across the electrodes. In operation, the electrodes 52, 54 produce an arc which ionizes the fill material to produce a plasma in the discharge chamber 50. The emission characteristics of the light produced by the plasma depend primarily on the constituents of the fill material, the current through the electrodes, the voltage across the electrodes, the temperature distribution of the chamber, the pressure in the chamber, and the geometry of the chamber.

As shown in FIG. 1, the discharge chamber 50 comprises a central body portion 60; and two end members 61, 63 including leg portions 62, 64. The ends of the electrodes 52, 54 are typically located near the opposite ends of the body portion 60. The electrodes are connected to a power supply by the conductors 56, 58 which are disposed within a central bore of each leg portion 62, 64. The electrodes are typically comprised of tungsten. The conductors typically comprise molybdenum and niobium.

The discharge chamber 50 is sealed at the ends of the leg portions 62, 64 with seals 66, 68. The seal 66, 68 is typically comprised of a disprosia-alumina-silica glass that can be formed by placing a glass frit in the shape of a ring around one of the conductors, eg. 56, aligning the discharge chamber 50 vertically and melting the frit. The melted glass then flows down into the leg 62, forming a seal between the conductor 56 and the leg 62. The discharge chamber is then turned upside down to seal the other leg 64 after the fill material is introduced.

The ceramic mixture used to form the chamber can comprise 60–90% by weight ceramic powder and 2–25% by weight organic binder. The ceramic powder may comprise alumina ($Al_2O_3$) having a purity of at least 99.98% and a surface area of about 1.5 to about 10 mg, typically between 3–5 $m^2$ g. The ceramic powder may be doped with magnesia to inhibit grain growth, for example in an amount equal to 0.03%–0.2%, preferably 0.05% by weight of the alumina. Other ceramic materials may be used include non-reactive refractory oxides and oxynitrides such as yttrium oxide and hafnium oxide and compounds of alumina such as yttrium-alumina-garnet and aluminum oxynitride. Binders which may be used individually or in combination include organic polymers, such as polyols, polyvinyl alcohol, vinyl acetates, acrylates, cellulosics, polyesters, stearates and waxes.

According to one example, the binder comprises: 33⅓ parts by weight parafin wax, melting point 52–58° C.; 33⅓ parts by weight parafin wax, melting point 59–63° C.; and 33⅓ parts by weight parafin wax, melting point 73–80° C.

The following substances are added to the 100 parts by weight parafin wax.

4 parts by weight white beeswax; 8 parts by weight oleic acid; 3 parts by weight aluminum stearate.

A sintering step may then be carried out by heating the parts in hydrogen having a dew point of about 10–15°. Typically, the temperature increases from room temperature to about 1300° C. over a two hour period. The temperature is held at about 1300° C. for about 2 hours. Next, the temperature is increased by about 100° C. per hour up to a maximum temperature of about 1850–1880° C. The temperature is held at about 1850–1880° C. for about 3.5 hours. Finally, the temperature is decreased to room temperature over about two hours. The resulting ceramic material comprises densely sintered polycrystalline aluminum.

As described above, an ignitable fill is added to the CMH lamp discharge chamber. The fill includes mercury, an inert gas such as argon, krypton or xenon and halides of a rare earth metal (RE) selected from scandium, yttrium, lanthanum, cerium, praseodymium, neodymium, promethium, semarium, europium, gadolinium, terbium, dysprosium, holmium, erbium, thulium, ytterbium and lutetium. In addition, the fill includes halides of sodium, calcium and thallium. Typically, the halide element is selected from chlorine, bromine and iodine. The halide compounds usually will represent stoichiometric relationships such as NaI, $CaI_2$ and $DyI_3$. Preferably, the mercury dose will comprise about 3 to 7 mg per cc of arc tube volume, and the inert gas fill about 60 to 200 torr at room temperature.

Representative molar fractions for the above-identified halides include the following ranges: Constituent Molar Fraction

| Constituent | Molar Fraction |
|---|---|
| RE halide | >0–15; preferably 4–8% |
| Cs halide | ≧0–15; preferably 4–8% |
| Na halide | 45–86% |
| TI halide | 2–5% |
| Alkaline earth metal halide | 15–45%, preferably 15–35% |

Preferably, the rare earth element is selected from Ho, Dy, and Tm. Particularly, preferred within this group is Ho. However, the inclusion of at least three rare earths have been shown beneficial. Preferably, the alkaline earth metal is selected from calcium, strontium and barium, most preferably calcium.

According to a further aspect, the fill preferably satisfies the molar ratio formula: $2 \leqq Na/(TII+REI_3) \leqq 10$, preferably $6 \leqq Na/(TII+REI\ 3) \leqq 10$ In addition, the cesium halide to rare earth halide dose satisfies the molar ratio: $CsH/REH_3 \leqq 1$.

The present invention is described in greater detail with reference to the following example, provided to illustrate but not limit the scope of the limitation.

EXAMPLES

250 W lamps were tested using a ceramic arctube whose body was 33.7 mm long and 15.6 mm diameter when measured on the outside. The ceramic arctube volume was 4.1 cc, and the arc gap between the electrode tips was 23.7 mm. The arctubes in cells A and B were dosed with 18 mg of mercury, and 50 mg of metal halide. Calcium iodide was included in the lamps of cell B which demonstrated an Ra 10 points greater than those in cell A. A further cell H was evaluated wherein cesium iodine was included in the dose. The cesium presence was not deleterious to lamp function and has been found to improve lamp life in horizontal burn orientations.

| Data from test CMH203 | 250 W, cell A | 250 W, cell B | 250 W, cell H |
|---|---|---|---|
| Rare Earth metal | Dy—Ho—Tm mixture | Dy—Ho—Tm mixture | Dy—Ho—Tm mixture |
| Rare earth iodide molar fraction | 8.5% | 5.6% | 5.2% |
| Cesium molar fraction | 0.0% | 0.0% | 5.2% |
| Sodium iodide molar fraction | 86% | 57% | 52% |
| Sodium to Rare Earth plus thallium molar ratio | 6.2 | 6.2 | 6.2 |
| Thallium iodide molar fraction | 5.4% | 3.6% | 3.3% |
| Calcium iodide molar fraction | 0% | 34% | 34% |
| Mercury dose (mg) | 17.9 | 17.9 | 20.4 |
| Measured performance on HPS ballast, burning horizontal | Vop = 114 V<br>Pop = 258 W<br>PF = 0.83<br>CCT = 3027<br>Ra = 76<br>flux = 24750 lm<br>eff = 96 lm/W | Vop = 110 V<br>Pop = 262 W<br>PF = 0.86<br>CCT = 3105<br>Ra = 87<br>flux = 24218<br>eff = 93 lm/W | Vop = 112 V<br>Pop = 262 W<br>PF = 0.86<br>CCT = 3016<br>Ra = 85<br>flux = 23344<br>eff = 89 lm/W |

Although the invention has been described with reference to the exemplary embodiments, various changes and modifications can be made without departing from the scope and spirit of the invention. For example, the disclosure focused on a ceramic discharge chamber comprised of alumina. Other ceramic compositions, including sapphire, AlN, etc. are known to the skilled artisan and would clearly be suitable for use in combination with the subject ionizable fill. These types of modifications are intended to fall within the scope of the invention as defined by the following claims:

What is claimed is:

1. A metal halide lamp comprised of a ceramic discharge chamber containing an ionizable fill, said fill comprising Hg, and halides (H) of Na, TI, an alkaline earth metal, and a rare earth element (RE) wherein a molar ratio percentage of moles of the TIH to the total number of moles of the halide fill constituents is from 2% to 5% and further wherein said molar ratio percentage for said rare earth halide is from>0 to <15%.

2. The metal halide lamp of claim 1 wherein said fill further comprises Cs halide.

3. The metal halide lamp of claim 2 comprising molar fraction the halides in the following ranges:

| | % |
|---|---|
| REH | >0–15 |
| CsH | >0–15 |
| NaH | 45–86 |
| TlH | 2–5 |
| CaH | 15–45 |

4. The lamp of claim 1 wherein said rare earth element is selected from Ho, Dy, Tm, and mixtures thereof.

5. The lamp of claim 4 wherein said rare earth element is Ho.

6. The lamp of claim 1 having a power greater than 200 watts.

7. The lamp of claim 1 having a power between about 250 and 400 watts.

8. The lamp of claim 4 wherein said ionizable fill includes only a single rare earth element.

9. The lamp of claim 1 having a color temperature between about 2500 and 4500° K.

10. The lamp of claim 9 having a color temperature between about 2800 and 3200° K.

11. A metal halide lamp comprised of a ceramic discharge chamber containing an ionizable fill, said fill comprising Hg and halides of Na, TI an alkaline earth metal and a rare earth element wherein a molar ratio percentage of said rare earth halide is from >0 to <15% and further wherein said lamp has a color rendering index of greater than 80.

12. The lamp of claim 1 wherein said halide is selected from chlorine, bromine, iodine and mixtures thereof.

13. The lamp of claim 1 wherein said alkaline earth metal comprises calcium.

14. The lamp of claim 1 having a molar ratio wherein: $2 \leqq NaH/(TlH+REH_3) \leqq 10$.

15. The lamp of claim 13 wherein: 15% ≦moles CaH/total number of moles of the halides fill constituents ≦45%.

16. The lamp of claim 1 wherein: 0.85<power factor<0.90.

17. The lamp of claim 1 wherein: 80<operating voltage<110 volts in a vertical burn orientation.

18. The lamp of claim 17 wherein: 90<operating voltage<120 volts in a horizontal burn orientation.

19. The lamp of claim 1 wherein: 4%≦moles REH/total number of moles of the halides fill constituents ≦8%.

20. The lamp of claim 1 wherein: 45%≦moles NaH/total number of moles of the halides fill constituents ≦86%.

21. A metal halide lamp comprised of a ceramic discharge chamber containing an ionizable fill, said fill comprising mercury, and halides of sodium, thallium, an alkaline earth metal and 0% ≦at least 3 rare earth elements <15%.

22. A metal halide lamp comprised of a ceramic discharge chamber containing an ionizable fill, said fill comprising mercury, and halides (H) of sodium, thallium, an alkaline earth metal, at least one rare earth element and cesium wherein a molar ratio percentage of TIH to the total number of moles of halide is from 2% to 5%.

23. A dose for a metal halide lamp comprised of mercury, and halides (H) of sodium, thallium, an alkaline earth metal, at least three rare earth elements, and cesium wherein said lamp has a color rendering index of greater than 80.

* * * * *